US005846348A

United States Patent [19]

Sakoda et al.

[11] Patent Number: 5,846,348

[45] Date of Patent: Dec. 8, 1998

[54] HIGH STRENGTH AND TOUGHNESS ALUMINUM ALLOY CASTING BY HIGH-PRESSURE CASTING METHOD AND METHOD OF MANUFACTURING SAME

[75] Inventors: Shoichi Sakoda, Minamikawach-machi; Akira Hideno, Sakama Koga; Nobuaki Ohara, Nakaguki Oyama, all of Japan

[73] Assignee: The Furukawa Electric Co., Ltd., Japan

[21] Appl. No.: 703,432

[22] Filed: Aug. 26, 1996

[30] Foreign Application Priority Data

Aug. 30, 1995 [JP] Japan ..... 7-222281

[51] Int. Cl.[6] ..... C22C 21/08; C22C 21/10

[52] U.S. Cl. ..... 148/439; 148/549; 420/535

[58] Field of Search ..... 148/549, 439; 420/535

[56] References Cited

U.S. PATENT DOCUMENTS 5,571,347 11/1996 Bergsma ..... 148/439

FOREIGN PATENT DOCUMENTS 53-133518 11/1978 Japan ..... 148/549

63-203755 8/1988 Japan ..... 148/549

*Primary Examiner*—Deborah Yee

*Attorney, Agent, or Firm*—Lorusso & Loud

[57] ABSTRACT

An aluminum alloy cast molding produced by a high-pressure casting method, and having a composition containing Si in an amount of 0.6 to 1.0% by weight (which will be hereinafter simply referred to as %), Cu in an amount of 0.6 to 1.2%, Mg in an amount of 0.8 to 1.2%, Zn in an amount of 0.4 to 1.2%, Ti in an amount of 0.01 to 0.20%, and B in an amount of 0.002 to 0.015%, with the remainder being aluminum and inevitable impurities. The maximum dendrite cell size of the metal structure of the aluminum alloy casting is limited to 60 $\mu$m or less. The present invention also provides a method of manufacturing an aluminum alloy casting by high-pressure casting, which manufacturing method includes the steps of charging a mold with a molten aluminum alloy having the above alloy composition, and subsequently solidifying the charged molten metal under pressures as high as 500 Kgf/cm$^2$ or above so that the maximum dendrite cell size of the metal structure of the aluminum alloy casting is limited to 60 $\mu$m or less.

3 Claims, 2 Drawing Sheets

HIGH STRENGTH AND TOUGHNESS ALUMINUM ALLOY CASTING BY HIGH-PRESSURE CASTING METHOD AND METHOD OF MANUFACTURING SAME

BACKGROUND OF THE INVENTION

1. Field of the Invention

This invention relates to an aluminum alloy casting for car brake parts, suspension parts, and the like, and more particularly, to an aluminum alloy casting produced by a high-pressure casting method, which has improved strength, elongation and toughness in comparison with a conventional aluminum alloy casting, and is equivalent in properties to a forged product, and to a method of manufacturing such an aluminum alloy casting.

2. Description of the Prior Art

There has been a tendency for car suspension parts such as upper arms, lower arms and knuckle arms to more frequently use aluminum alloys, instead of steel materials, from the viewpoint of a demand for more lightweight cars. As materials for satisfying the above demand, use has been frequently made of Al—Mg—Si alloys having relatively satisfactory corrosion resistance and excellent workability. In particular, JIS 6061 alloy (i.e., Al—Mg—Si—Cu—Cr alloy with a composition of Mg in an amount of 1.0% by weight, Si in an amount of 0.6% by weight, Cu in an amount of 0.3% by weight and Cr in an amount of 0.2% by weight) and 6N01 alloy (i.e., Al—Mg—Si alloy with a composition of Mg in an amount of 0.6% by weight, and Si in an amount of 0.6% by weight), have been forged to manufacture protection parts having the high strength and toughness required for such protection parts.

However, these materials have the disadvantages of lower yield and higher cost of manufacture, since an extruded material cut to an appropriate length has been formed from these materials in most cases and has been worked through a large number of steps such as preforming, rough forging and finish forging.

On the other hand, aluminum alloy castings have been used for a high percentage of car parts, since the aluminum alloy castings enable manufacture of parts of a complicated shape at low cost. Al—Cu—Mg AC1B (i.e., Al—Cu—Mg—Ti alloy with a composition of Cu in an amount of 4.5% by weight, Mg in an amount of 0.25% by weight and Ti in an amount of 0.2% by weight), Al—Cu—Si AC2B (i.e., Al—Cu—Si alloy with a composition of Cu in an amount of 3.0% by weight and Si in an amount of 6.0% by weight), and Al—Si AC3A (i.e., Al—Si alloy with a composition of Si in an amount of 11.5% by weight) and the like are available for casting alloys. On the other hand, use has been frequently made of Al—Si—Mg AC4C (i.e., Al—Si—Mg alloy with a composition of Si in an amount of 7.0% by weight and Mg in an amount of 0.3% by weight), AC4CH (i.e., Al—Si—Mg alloy with a composition of Si in an amount of 7.0% by weight and Mg in an amount of 0.35% by weight) and like casting alloys which are improved in mechanical properties by adding a small amount of Mg to Al—Si alloys having satisfactory castability so as to attain the effect of heat treatment, i.e. high strength, high toughness and corrosion resistance. However, these casting alloys frequently produce internal defects in casting, contain a high amount of dissolved hydrogen gas in the molten metal which easily produces gas defects such as blow holes and blisters after the heat treatment, and are inferior in strength to forged materials. Therefore, in the present state of affairs, the range of use for these casting alloys is limited to car mechanical parts, thin members such as covers and members which require relatively low strength.

Recently, an attempt has been made at overcoming the problems in casting by employing a high-pressure casting method so as to satisfy the strength requirements, which method has been put to practical use in the casting of alloys to produce some of the parts. However, these casting alloys have not yet been used to manufacture significant protection parts, instead of the currently-used forged materials. Further, no high strength and tough product has yet been attained which would satisfy a demand for smaller thickness.

Wrought Al and Al alloys, which improve in mechanical properties by heat treatment, have been tested in high-pressure casting methods. However, the wrought Al and Al alloys have disadvantages in that casting cracks and macro segregations to a finally-solidified portion easily occur.

Further, in casting of, not only the wrought Al and Al alloys, but also the usual casting alloys, a portion in the neighborhood of a sprue, through which molten metal is charged, and thick portions are slower than a front end of a cavity or a thin portion in speed of solidification after charging with the molten metal. Therefore, dendrite cell size is coarsened, the mechanical properties are degraded, and the internal structure of the product does not become homogenized as a whole.

An object of the present invention is to overcome the above problems, and more specifically, to provide a casting, which is usable for car parts, which has mechanical properties equivalent to forged materials, irrespective of thickness, and which can be manufactured at low cost, as compared with the forged materials, and a method of manufacturing such a casting for car parts.

SUMMARY OF THE INVENTION

As the result of research to attain the above object, it was found that the above-mentioned AC4CH (i.e., Al—Si—Mg alloy with a composition of Si in an amount of 7.0% by weight and Mg in an amount of 0.35% by weight), widely used as a casting alloy, produces a casting of excellent internal quality in high-pressure casting, but is limited in its mechanical properties, and does not attain any properties superior to those of the currently-used forged materials.

Subsequent research using wrought Al and Al alloys, which are improved in mechanical properties by heat treatment, in a high-pressure casting method resulted in attainment of the present invention.

The present invention provides a high strength and tough aluminum alloy casting by a high-pressure casting method, having a composition containing Si in an amount of 0.6 to 1.0% by weight (which will be hereinafter simply referred to as %), Cu in an amount of 0.6 to 1.2%, Mg in an amount of 0.8 to 1.2%, Zn in an amount of 0.4 to 1.2%, Ti in an amount of 0.01 to 0.20%, and B in an amount of 0.002 to 0.015%, with the remainder being aluminum and inevitable impurities, wherein the maximum dendrite cell size of the metal structure of the aluminum alloy casting is limited to 60 $\mu$m or less.

The present invention also provides a method of manufacturing a high strength and tough aluminum alloy casting by a high-pressure casting method, which method comprises the steps of charging a mold with a molten aluminum alloy having a composition containing Si in an amount of 0.6 to 1.0%, Cu in an amount of 0.6 to 1.2%, Mg in an amount of 0.8 to 1.2%, Zn in an amount of 0.4 to 1.2%, Ti in an amount of 0.01 to 0.20% and B in an amount of 0.002 to 0.015%, with the remainder being aluminum and inevitable impurities, and subsequently solidifying the charged molten metal under pressures as high as 500 Kgf/cm$^2$ or above, so that the maximum dendrite cell size of the metal structure of the aluminum alloy casting is limited to 60 $\mu$m or less.

Reasons why the components of the alloy composition of the present invention are limited to the above-mentioned ranges will now be explained.

Si and Mg are effective in improving the strength by precipitating $Mg_2Si$ in the heat treatment after pouring. When the amounts of Si and Mg added are respectively less than 0.6 and 0.8%, Si and Mg do not have the effect of satisfactorily improving the strength. On the other hand, when the amounts of Si and Mg added respectively exceed 1.0 and 1.2%, while satisfactory strength is attained, the toughness and corrosion resistance are remarkably reduced. Accordingly, the amounts of Si and Mg added are respectively limited to the range of 0.6 to 1.0% and the range of 0.8 to 1.2%.

Cu is effective in improving the strength after the heat treatment together with Mg and Si. When the amount of Cu added is less than 0.6%, satisfactory strength is not attained. On the other hand, when the amount of Cu added exceeds 1.2%, the corrosion resistance is reduced. Accordingly, the amount of Cu added is limited to the range of 0.6 to 1.2%.

Zn is dissolved in a matrix and is effective in improving the strength of the matrix itself, and also in making a fine dendrite cell structure. When the amount of Zn added is less than 0.4%, Zn does not have the effect of satisfactorily making the dendrite cell structure fine. On the other hand, when the amount of Zn added exceeds 1.2%, solidification cracks are easily produced, and the corrosion resistance is degraded. Accordingly, the amount of Zn added is limited to the range of 0.4 to 1.2%.

Ti and B are effective in making a fine cast structure, in preventing casting cracks from being produced on the surface of a casting, and also in preventing macro segregations from being produced in the neighborhood of a sprue portion which is the last solidified portion. When the amounts of Ti and B added are respectively less than 0.01 and 0.002%, Ti and B do not have the above effects. On the other hand, when the amounts of Ti and B added respectively exceed 0.20 and 0.04%, a coarse inclusion is formed which degrades the mechanical properties. Accordingly, the amounts of Ti and B added are respectively limited to the range of 0.01 to 0.2%, and the range of 0.002 to 0.04%.

Incidentally, even if Fe and Mn are respectively contained in an amount of 0.5% or less as inevitable impurities, Fe and Mn do not have any bad effect on the present invention.

With the aluminum alloy of the present invention, in addition to the limitations on the alloy composition described above, the maximum dendrite cell size of the metal structure of a casting is limited to 60 $\mu$m or less in order to improve the mechanical properties. When the maximum dendrite cell size exceeds 60 $\mu$m, the aluminum alloy casting of the present invention does not have the desired properties.

A casting frequently varies in thickness as between different portions of a product. Therefore, the technical requirement that the maximum dendrite cell size be limited to 60 $\mu$m means that the maximum dendrite cell size in every portion of the casting is limited to 60 $\mu$m.

In the method of the present invention, the mold is charged with the molten aluminum alloy of the above composition, and thereafter, the charged molten metal is solidified under pressures as high as 500 Kgf/cm$^2$ or above in order to prevent a shrinkage cavity and casting cracks from being produced and to make the metal structure of each portion of the casting fine. Thus, the method of the present invention improves the mechanical properties, in particular the elongation, by limiting the maximum dendrite cell size to as small as 60 $\mu$m or less. When the casting pressure is less than 500 Kgf/cm$^2$, a shrinkage cavity and casting cracks are frequently produced to remarkably degrade the mechanical properties, in particular the elongation.

Incidentally, a higher casting pressure is preferable. However, the usual mold cannot bear up against an extremely high pressure, and an expensive mold is required. Accordingly, the casting pressure is preferably limited to the range of 600 to 1200 kgf/cm$^2$.

The temperature of the molten aluminum alloy filled into the mold is preferably limited to the normally-applied range, i.e., the range of an alloy liquidus line temperature to the liquidus line temperature+100° C., in order to stably obtain a homogeneous dendrite cell structure regardless of thickness. Specifically, the molten metal temperature in this case means the temperature of the molten metal at the sprue portion immediately before the mold is charged with the molten metal.

It is conceivable that the temperature of the molten metal at the sprue portion immediately before the mold is charged with the molten metal might be stably held within a range from the liquidus line temperature to the liquidus line temperature+100° C. by coating the inner surface of a ladle with a heat-insulation material, such as ceramic, to prevent the molten metal temperature from being reduced in the pouring of the molten metal into a plunger sleeve from the ladle. However, according to this method, when the molten metal is poured from the ladle into the plunger sleeve, an oxide film is produced, and as an inevitable result, the mechanical properties become unstable. Accordingly, as a means for supplying the molten metal from the ladle into the plunger sleeve, use is preferably made of an electromagnetic pump, a metal pump or the like which is unlikely to produce a turbulent flow in the molten metal and which is able to pour the molten metal at high speed.

Further, in order to prevent, as much as possible, the molten metal temperature from being reduced when the mold is charged with the molten metal, use is preferably made of an injection sleeve lined on its inner surface with a highly heat-insulating ceramic, instead of the usual steel injection sleeve.

The aluminum alloy casting according to the present invention is heat-treated depending on the properties required for the final product, but the heat treating conditions are not particularly limited. Namely, the aluminum alloy casting according to the present invention, manufactured as described above, is subjected to normal solution heat-treatment, hardening and aging, and as a result, it is possible to considerably improve its strength, elongation and toughness.

BRIEF DESCRIPTION OF THE DRAWINGS

The foregoing and other objects and features of the invention will become apparent from the following description of a preferred embodiment of the invention with reference to the accompanying drawings, in which.

DESCRIPTION OF THE PREFERRED EMBODIMENT (EXAMPLE 1)

Figure 1:
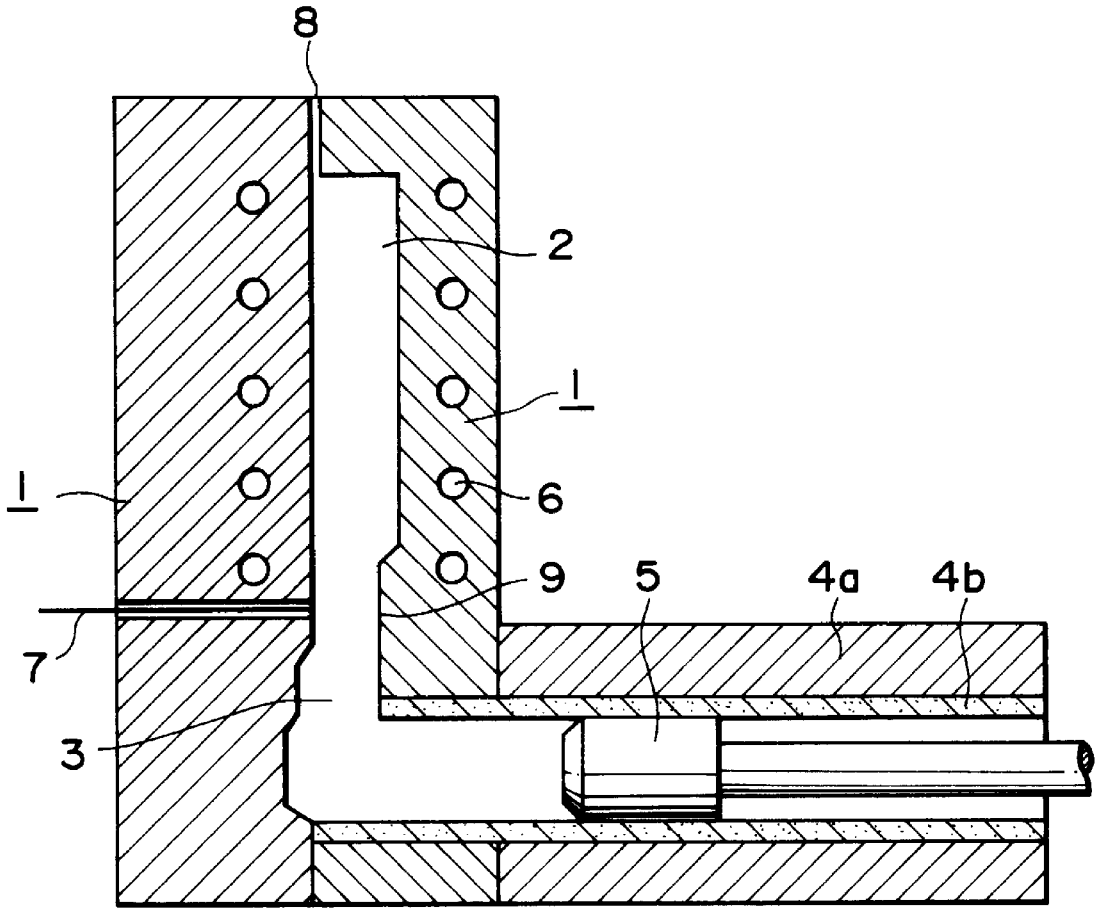
FIG. 1 is a schematic sectional view showing an essential part of a pressure casting apparatus in an embodiment of the present invention.

A casting apparatus shown in FIG. 1 was used for casting. This casting apparatus comprises a mold 1 having a cavity 2, a molten metal supply path 3, an injection sleeve 4*a*, into which a certain amount of molten metal is poured, and a plunger 5 slidably moved within the injection sleeve to charge the cavity with the molten metal and to apply pressure to the molten metal. In this casting apparatus, the inner surface of the injection sleeve 4*a* is lined with ceramic 4*b* so as to prevent the molten metal from cooling.

The mold 1 has water-cooling pipes 6 arranged at certain intervals along the cavity 2 to provide cooling with water during the injection and charging of the molten metal.

Table 1 shows the compositions of aluminum alloys used in Example of the present invention and Comparative examples.

TABLE 1

| | Alloy | Alloy composition (% by weight) | | | | | | | | |
|---|---|---|---|---|---|---|---|---|---|---|
| | No. | Si | Fe | Cu | Mg | Zn | Ti | B | Al | Remarks |
| Example of the invention | 1 | 0.90 | 0.17 | 0.75 | 1.00 | 0.80 | 0.05 | 0.010 | Remainder | |
| Comparative examples | 2 | 0.40 | 0.17 | 0.55 | 0.60 | — | 0.03 | 0.006 | Remainder | |
| | 3 | 0.70 | 0.17 | 0.30 | 1.00 | — | 0.02 | 0.004 | Remainder | Corresponding to JIS, 6061 alloy |
| | 4 | 0.70 | 0.17 | 0.75 | 1.00 | — | — | — | Remainder | |
| | 5 | 0.90 | 0.17 | 0.75 | 1.00 | 0.30 | 0.05 | 0.008 | Remainder | |
| | 6 | 7.50 | 0.17 | — | 0.35 | — | 0.10 | — | Remainder | Corresponding to JIS, AC4CH alloy |

Each aluminum alloy having the composition shown in Table 1 was melted according to a normal method, and degassed by means of Ar-gas bubbling at the molten metal temperature of 700° for about 20 min. Subsequently, the resultant aluminum alloy was subjected to pressure casting under the casting conditions shown in Table 2 to prepare a flat test piece having a thickness of 20 mm, a width of 100 mm and a length of 200 mm.

At this stage, the molten metal temperature immediately before pouring was measured by a thermocouple 7 installed in the molten metal supply path 3, after the molten metal has been poured into the injection cylinder. The temperature of the mold during pouring was controlled by varying the amount of water supplied through each water-cooling pipe, while pouring the molten metal.

A section of each of these aluminum alloy castings was polished, and thereafter examined with a stereoscope for the presence or absence of internal defects, such as a shrinkage cavity and casting cracks, and the maximum dendrite cell structure.

Further, after the test piece has been heat-treated (i.e., subjected to solution heat treatment at 540° C. for 8 hours, subsequently cooling with water, and aging at 180° C. for 8 hours), a tension test piece and a Charpy test piece were sampled from the test piece, corresponding to the front end of the cavity, to measure a tensile strength, a yield point, an elongation and a Charpy impact value serving as an index value of toughness. Table 2 shows the results of the measurement.

TABLE 2

| | | | Casting conditions | | Internal quality | | | Mechanical properties after heat treatment | | | |
|---|---|---|---|---|---|---|---|---|---|---|---|
| | Test piece No. | Alloy No. | Molten metal temperature °C. | Casting pressure kgf/cm$^2$ | Dendrite cell size MAX ($\mu$m) | Presence or absence of shrinkage cavity | Presence or absence of castings crackings | Tensile strength (N/mm$^2$) | Yield point (N/mm$^2$) | Elongation (%) | Charpy impact value (J/cm$^2$) |
| Examples of the invention | 1 | 1 | 670 | 750 | 50 | Absence | Absence | 403 | 360 | 18 | 39 |
| | 2 | 1 | 720 | 1200 | 40 | Absence | Absence | 405 | 360 | 18 | 45 |
| Comparative examples | 3 | 1 | 670 | 350 | 45 | Presence (frequently) | Presence (frequently) | — (Impossible to make tension test) | — | — | — |
| | 4 | 2 | 670 | 750 | 80 | Absence | Absence | 274 | 245 | 11 | 35 |
| | 5 | 3 | 670 | 750 | 80 | Absence | Absence | 329 | 303 | 14 | 37 |
| | 6 | 4 | 670 | 750 | 100 | Absence | Presence (frequently) | — (Impossible to make tension test) | — | — | — |
| | 7 | 5 | 670 | 750 | 80 | Absence | Absence | 380 | 350 | 12 | 37 |
| | 8 | 6 | 670 | 750 | 120 | Absence | Absence | 335 | 287 | 14 | 17 |

As is obvious from Table 2, with respect to the test pieces (Nos. 1 and 2) prepared by pouring the alloy having the composition according to the present invention under the predetermined casting conditions, no internal defect is observed, and the maximum dendrite cell size is small. Accordingly, it is found that the test pieces Nos. 1 and 2 are superior in strength and toughness to AC4CH alloy casting (No. 8), heretofore having been used for a high-pressure casting method.

On the other hand, with respect to the test pieces (Nos. 4 to 7) respectively having alloy compositions outside the range of the present invention, satisfactory strength and toughness are not attained. With respect to the test piece (No. 3), prepared by using the casting pressure outside the range of the present invention, although its alloy composition is within the range of the present invention, it is found that internal defects such as a shrinkage cavity and casting cracks are frequently produced in the product and there is a tendency toward poorer mechanical properties.

(EXAMPLE 2)

Each of the aluminum alloys Nos. 1 and 5 respectively having the compositions shown in Table 1 was melted according to a normal method, and degassed by means of Ar-gas bubbling through the molten metal at a temperature of 700° C. for about 20 min. Subsequently, the resultant aluminum alloy was subjected to pressure casting under the casting conditions shown in Table 3 to prepare a stepped flat test piece having a thickness of 5 to 20 mm, a width of 100 mm and a length of 200 mm. After the test piece has been heat-treated (i.e., subjected to solution heat treatment at 540° C. for 8 hours, subsequently cooling with water and aging at 180° C. for 8 hours), a tension test piece was sampled from each thick portion of the test piece to measure a tensile strength and an elongation. Table 3 shows the results of the measurement.

TABLE 3

| | Casting conditions | | | | Mechanical properties | | | | | |
|---|---|---|---|---|---|---|---|---|---|---|
| | | | Molten | | Thickness 20 mm (20 t) | | Thickness 10 mm (10 t) | | Thickness 5 mm (5 t) | |
| | Test piece No. | Alloy No. | metal temperature °C. | Casting pressure kgf/cm$^2$ | Tensile strength (N/mm$^2$) | Elongation (%) | Tensile strength (N/mm$^2$) | Elongation (%) | Tensile strength (N/mm$^2$) | Elongation (%) |
| Example of the invention | 10 | 1 | 670 | 750 | 403 | 18 | 404 | 20 | 405 | 19 |
| Comparative example | 11 | 5 | 670 | 750 | 380 | 12 | 397 | 14 | 399 | 17 |

Figure 2A:
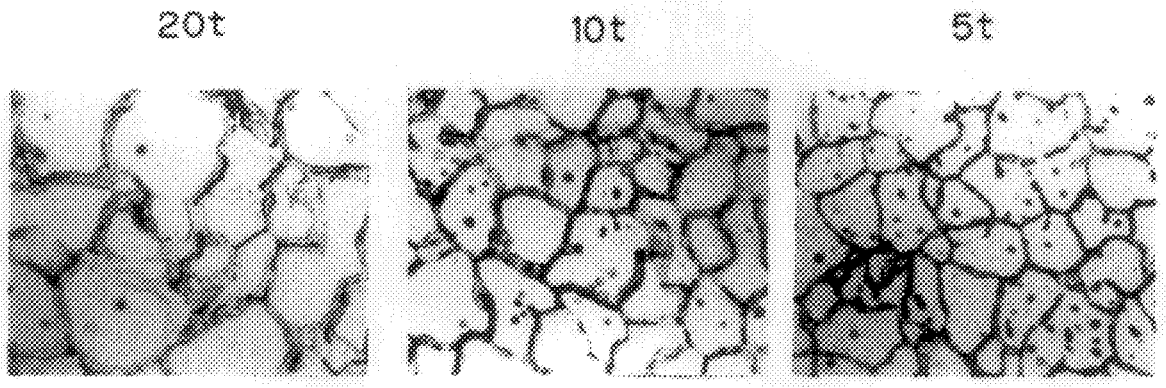
FIG. 2 shows microstructure photographs (400× magnifications) of an aluminum alloy casting, in which photographs (A) are microstructure photographs of portions which are respectively 20 mm (20t), 10 mm (10t) and 5 mm (5t) in thickness as Example of the present invention, and photographs (B) are microstructure photographs of portions which are respectively 20 mm (20t), 10 mm (10t) and 5 mm (5t) in thickness as a Comparative example.
Figure 2B:
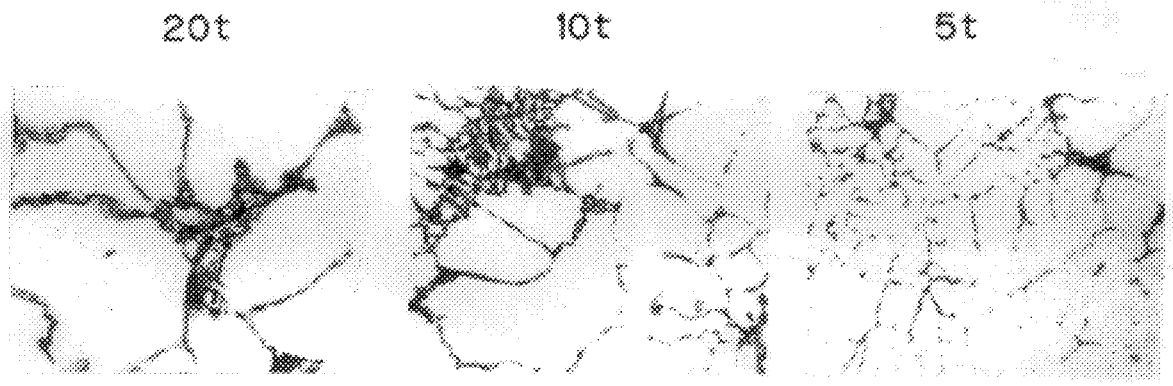

Further, the test pieces shown in Table 3 were subjected to etching according to a normal method, and the dendrite cell structure in each thick portion of the test pieces was observed with an optical microscope. FIG. 2 shows the microstructure photographs of each thick port on of the test pieces.

Referring to FIG. 2, photographs (A) are microstructure photographs (400× magnifications) of portions which are respectively 20 mm (20t), 10 mm (10t) and 5 mm (5t) in thickness as an Example of the present invention, and photographs (B) are microstructure photographs of portions which are respectively 20 mm (20t), 10 mm (10t) and 5 mm (5t) in thickness as obtained in the Comparative example.

The maximum dendrite cell size of the structure shown in the photographs (A) was 50 $\mu$m (in the portion of a thickness of 20 mm), and the maximum dendrite cell size of the structure shown in the photographs (B) was 100 $\mu$m (in the portion having a thickness of 20 mm).

As is obvious from Table 3 and FIG. 2, with respect to the test piece (No. 10) prepared by pouring the alloy of the present invention under the predetermined casting conditions, the dendrite cell size is small and there is no great difference in dendrite cell size as between the different thicknesses. Further, there is no great difference in mechanical properties (in particular, the elongation), and as a result, it is found that the homogeneity is attained over the whole product.

As has been described in the foregoing in detail, according to the present invention, it is possible to obtain the aluminum alloy casting with improved strength and toughness in comparison with the conventional aluminum alloy casting. Further, the variation in properties of the internal structure of the product is remarkably reduced, so that the aluminum alloy casting of the present invention may be used for car suspension parts (i.e., upper arms and lower arms and the like) requiring reliability of the product as a whole and also to brake parts and the like requiring pressure resistance. Furthermore, since the aluminum alloy casting of the present invention is equivalent in properties to forged materials, the present invention provides the industrial advantages of reducing the cost of manufacture and so on.

We claim:

1. A high strength and toughness aluminum alloy casting, produced by introducing the aluminum alloy in a molten state into one end of a three-dimensional mold in a high-pressure casting method, said cast molding having portions of significantly different thicknesses, said portions being homogeneous in tensile strength and elongation, said aluminum alloy having a composition containing Si in an amount of 0.6 to 1.0% by weight, Cu in an amount of 0.6 to 1.2% by weight, Mg in an amount of 0.8 to 1.2% by weight, Zn in an amount of 0.4 to 1.2% by weight, Ti in an amount of 0.01 to 0.20% and B in an amount of 0.002 to 0.015%, with the remainder being aluminum and inevitable impurities;

said casting having maximum dendrite cell size of 60 $\mu$m.

2. A method of manufacturing a high strength and toughness aluminum alloy by a high-pressure casting method, comprising the steps of:

charging a molten aluminum alloy into one end of a three-dimensional mold having areas of significantly varying thickness, said aluminum alloy having a composition containing Si in an amount of 0.6 to 1.0% by weight, Cu in an amount of 0.6 to 1.2% by weight, Mg in an amount of 0.8 to 1.2% by weight, Zn in an amount of 0.4 to 1.2% by weight, Ti in an amount of 0.01 to 0.20% by weight and B in an amount of 0.002 to 0.015% by weight, with the remainder being aluminum and inevitable impurities; and subsequently solidifying the charged molten aluminum alloy under a pressure of at least 500 $Kgf/cm^2$ and sufficient to limit maximum dendrite cell size in the internal structure of the aluminum alloy casting to 60 $\mu m$ to produce a cast molding having portions of significantly different thicknesses, said portions being homogeneous in tensile strength and elongation.

3. A method of manufacturing a high strength and toughness aluminum alloy by a high-pressure casting method according to claim 2, wherein the molten metal of the aluminum alloy is solidified under pressures within the range of 600 to 1200 $Kgf/cm^2$.

* * * * *